US005312012A

United States Patent [19]

Zink

[11] Patent Number: 5,312,012

[45] Date of Patent: May 17, 1994

[54] VAPOR SPACE WATER HAMMER ELIMINATOR SYSTEM FOR LIQUID TRANSPORT APPARATUSES

[75] Inventor: Donald L. Zink, Billings, Mont.

[73] Assignee: Montana Sulphur & Chemical Company, Billings, Mont.

[21] Appl. No.: 804,548

[22] Filed: Dec. 11, 1991

Related U.S. Application Data

[63] Continuation of Ser. No. 594,169, Oct. 9, 1990, abandoned.

[51] Int. Cl.[5] ..... B65D 1/24

[52] U.S. Cl. ..... 220/563; 220/562; 220/501

[58] Field of Search ..... 220/501, 562, 563, 501, 220/562, 563; 105/360; 280/837, 838, 839

[56] References Cited

U.S. PATENT DOCUMENTS

| | | | |
|---|---|---|---|
| 935,210 | 1/1909 | Lindstrom . | |
| 1,661,324 | 5/1924 | Davis, Jr. . | |
| 2,497,020 | 2/1950 | Singer . | |
| 2,503,792 | 4/1950 | Brandon | 220/562 |
| 2,586,671 | 2/1952 | Landis . | |
| 2,732,040 | 3/1953 | DeVost et al. . | |
| 3,046,751 | 7/1962 | Gardner | 220/85 S X |
| 3,112,845 | 12/1963 | Bryant . | |
| 3,331,398 | 7/1967 | Goss . | |
| 3,388,823 | 6/1968 | Fleming et al. . | |
| 3,400,854 | 9/1968 | Conaway et al. . | |
| 3,520,437 | 7/1970 | Fleming et al. . | |
| 3,784,050 | 1/1974 | Pollack . | |
| 3,787,279 | 1/1974 | Winchester . | |
| 3,804,291 | 4/1974 | Fricker | 220/501 X |
| 3,902,624 | 9/1975 | Stephenson . | |
| 4,166,550 | 9/1979 | Kleinschmit et al. | 220/501 X |
| 4,172,573 | 10/1979 | Moore et al. | 220/900 X |
| 4,241,755 | 12/1980 | Snyder | 220/563 X |
| 4,251,005 | 2/1981 | Sons et al. . | |
| 4,305,428 | 12/1981 | Burton . | |
| 4,376,489 | 3/1983 | Clemens . | |
| 4,427,045 | 1/1984 | Headrick . | |
| 4,483,454 | 11/1984 | Rogers et al. | 220/562 |
| 4,624,388 | 11/1986 | Chang et al. | 220/435 |
| 4,796,773 | 1/1989 | Gerhard | 220/563 |
| 4,863,055 | 9/1989 | Bietz | 220/563 |
| 4,925,057 | 5/1990 | Childress et al. | 220/426 |
| 5,038,960 | 8/1991 | Seery | 220/403 |
| 5,117,873 | 6/1992 | Miyakawa et al. | 138/30 |

*Primary Examiner*—Steven M. Pollard

*Attorney, Agent, or Firm*—Banner, Birch, McKie & Beckett

[57] ABSTRACT

A liquid transport apparatus including an elongated liquid vessel for transporting compressible liquids, such as LPG. One or more longitudinal conduits having lower solid surfaces in the vapor space of compressible liquid are positioned within the liquid vessel. The compressible liquid within the conduits dissipates or eliminates the water hammer pressure resulting from the impact and prevents the walls of the liquid vessel from failing. The conduits can be in the form of one or more longitudinal pipes in the upper vapor space of the vessel with rupture discs at one or both ends thereof. A plurality of spaced apertures can be formed along the pipes. Further, a longitudinal baffle can be secured inside the vessel beneath the vessel top wall. The baffle can be used with or without the pipes, and if used with the pipes, it is positioned directly beneath them.

36 Claims, 5 Drawing Sheets

VAPOR SPACE WATER HAMMER ELIMINATOR SYSTEM FOR LIQUID TRANSPORT APPARATUSES

This application is a continuation of application Ser. No. 07/594,169, filed Oct. 9, 1990, now abandoned.

BACKGROUND OF THE INVENTION

The present invention relates to fluid transport vessels such as rail tank cars adapted to transport hazardous liquids. It further relates to systems for eliminating the water hammer effect resulting from vessel wrecks and derailments and thereby protecting the vessel end walls from failing.

One of the concerns in the transportation of liquified materials and particularly liquified hazardous materials in tank cars and tank trailers is the failure of the vessel during collisions or derailments. One of the modes of failure of any pressure vessel is the so-called "water hammer" effect. Water hammer is a transient pressure peak developed by sudden deceleration of a mass of fluid. The pressure developed is a direct function of the vessel's change in velocity and, therefore, is directly proportional to the velocity of the liquid and inversely proportional to the time during which deceleration occurs. Since the velocity of pressure wave propagation is about four thousand feet per second, the maximum pressure head (in feet of fluid) developed is roughly equal to: a times D divided by g, or $125 \times D$, where "a" is the velocity of pressure wave propagation in the system, "D" is the change in velocity in feet per second, and "g" is a dimensional constant of 32.17 (pounds)(feet)/(pound force) (seconds times seconds).

The peak value of the pressure developed is further reduced if the time of deceleration can be made greater than the time required for the pressure wave to travel from the point of stoppage (impact) to the point of reflection (the length of the vessel) and back. Since the velocity of wave propagation is about four thousand feet per second, this period is typically about one eightieth to one fiftieth of a second in a transport vessel. Limiting the speed of travel of such vessels is about the only way in which the initial velocity of the liquid can be reduced. However, changes in the vessel design can be made to extend the minimum time for deceleration or to absorb the pressure spike with a dramatic effect on the maximum pressure developed.

The primary cause of significant water hammer pressure in a transport vessel are head-on collisions of the vessel with immovable and inflexible objects, such as rock faces or concrete abutments, which impact the head of the vessel and thereby bring the vessel to a sudden stop. The fluid in the vessel continues to travel in the original direction and at the original speed for a very short period of time before the entire space at the head of vessel is filled with the relatively incompressible liquid. At this time, the kinetic energy of the moving liquid must be converted to pressure and dissipated thereby doing "work" on the walls of the vessel and on the liquid itself.

This pressure can as much as several thousand pounds per square inch in a tank car of a liquid, such as water, traveling at, for example, sixty miles per hour (eighty-eight feet per second). This is equal to about 5,000 psig, which is calculated as follows: $88 \times 125 = 1{,}100$ feet of head, or about 5,000 psig. This pressure can be enough to burst the end wall of the vessel. The peak pressure can be reduced by increasing the elasticity or compressibility of the system and by increasing the time allowed for deceleration.

The prior art has occasionally dealt with the water hammer problem in transportation vessels by increasing the wall thickness, and therefore its strength, sufficient to resist the water hammer pressures. Increasing the thickness of the walls is of limited practical value today, however, since at today's high transportation speeds extremely thick walls are required to resist pressures of several thousands pounds per square inch. The frequency of water hammer induced failures is fortunately low primarily because the probability of a wreck resulting in a nearly "instantaneous" stop of a massive pressure vessel is extremely low. Typically in such wrecks a considerable period of time, in fractions of seconds, is expended as the vessel crushes its way through soft rock, dirt or debris. This time can even extend to several seconds if the vessel rebounds, bounces, tumbles, slides or rolls during its deceleration. Another known design in light wall tanks, such as gasoline trailers, provides internal baffling to impede the flow the liquid from one end of the vessel to the other during controlled stops. This is shown for example in U.S. Pat. No. 4,251,005, whose entire contents are hereby incorporated by reference.

In piping systems, the water hammer problem is addressed in one of two basic ways. First, the minimum time for deceleration is extended by means of slow operating valves. Second, a means of absorbing or relieving the pressures developed is provided. This means can include placing pressure relief valves near the point of stoppage. Another means is by placing gas filled chambers or dampeners near the point of stoppage to expend the kinetic energy of the slowing liquid in compressing the gas of the dampener.

Additionally, containers, such as bumpers, bags or drums, filled with fluids, such as water, oil, gas or sand, are used by highway safety engineers to expend the kinetic energy of a highway collision over considerable distance, and therefore time, to mitigate the forces developed in the collision.

SUMMARY OF THE INVENTION

Accordingly, a principal object of the present invention is to provide a simple system which can be added to or built into transportation pressure vessels for reducing the probability of vessel failure due to water hammer pressure following a collision.

Directed to achieving this object, a novel fluid transport apparatus with a water hammer or eliminator system is herein provided. The system is positioned inside of the transportation pressure vessel so that the sudden acceleration or surge of the liquid within the vessel impacts directly on this internal system to thereby dissipate or eliminate the water hammer pressure. The system very simply comprises one or more breakable containers of compressed fluid positioned within the vessel and adapted to break by the force of the vessel fluid surging against them following a vessel impact. The breakable containers collapse and the compressible fluid therein absorbs the energy of the surging vessel fluid. The breakable containers can take many forms including end bladders positioned at preferably both ends of the vessel and having rupture discs or other weaknesses constructed therein, or a plurality of collapsible containers, such as ordinary tennis balls, held at one or both of the vessel ends.

Another system of this invention positions piping or passages longitudinally in the upper vapor space of the interior of the vessel with (optional) rupturable discs at both ends thereof. This piping can include small longitudinally spaced apertures. Lateral bafflings directly beneath the piping, spaced longitudinally relative to the vessel and secured inside of the vessel and to the vessel walls can also be provided. Although a less preferred design, the baffling can be used without the piping. This piping in the upper vapor space is thus substantially free of liquid at the time of impact.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
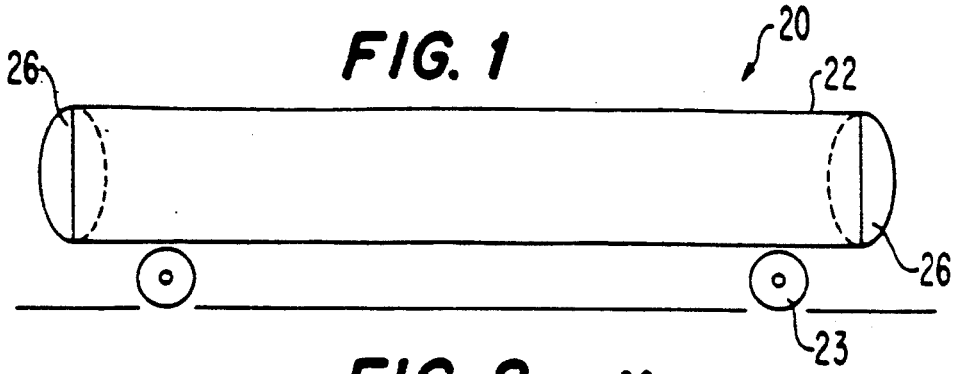
FIG. 1 is a schematic side elevational view of a first fluid transport apparatus of the present invention.

Referring to FIG. 1, a fluid transport apparatus of the present invention is illustrated generally at 20. The fluid transport apparatus 20 can comprise an existing elongated fluid transport vessel 22 supported on wheel assemblies 23 and equipped with water hammer pressure eliminator systems 26 as shown generally in FIG. 1 at both ends of and inside of the vessel 22. The fluid transport vessel 22 can be adapted for transporting liquified materials 24, and particularly liquified hazardous materials such as liquified pressurized gas, and can comprise a tank car or a tank trailer.

Figure 2:
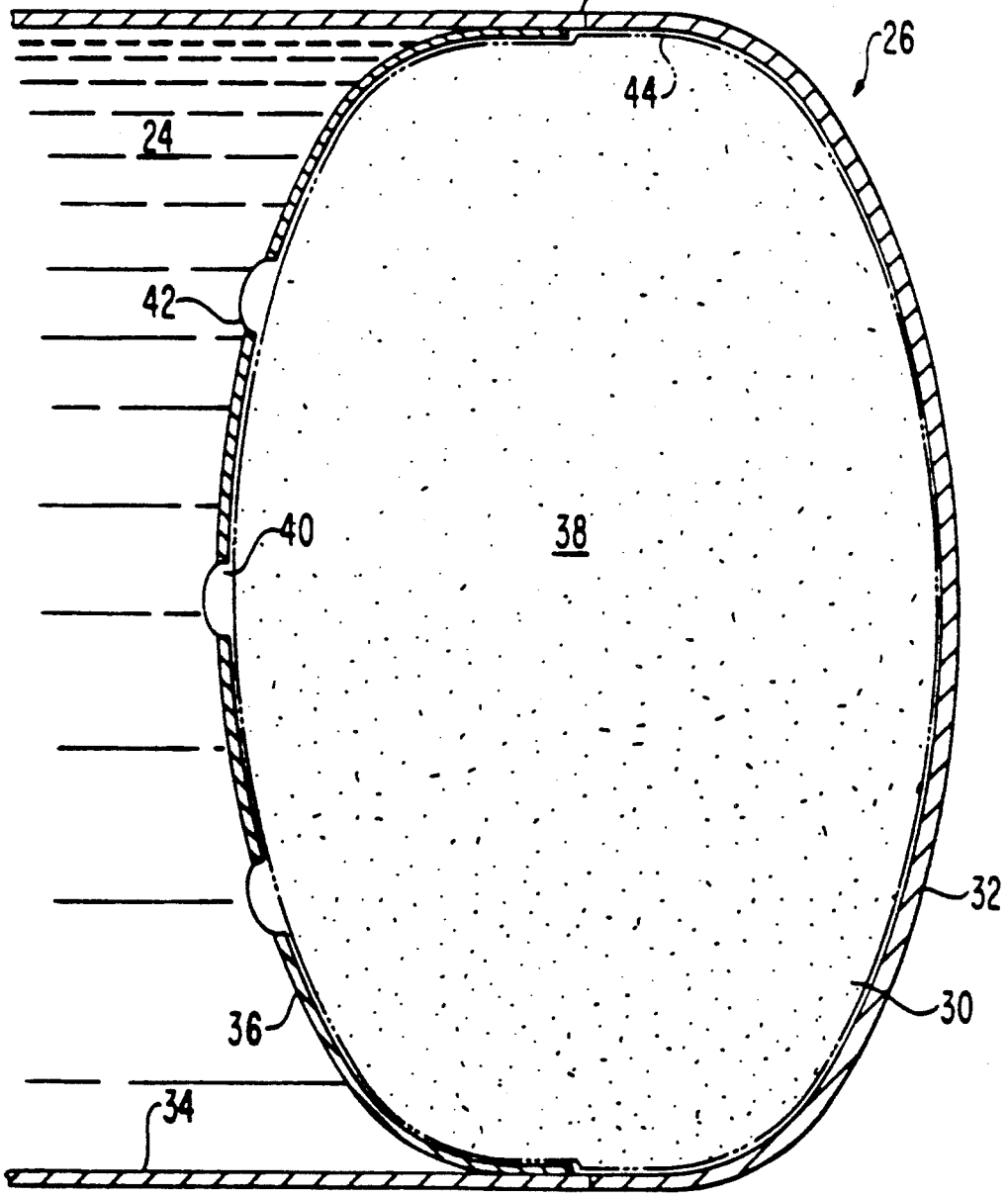
FIG. 2 is an enlarged longitudinal cross-sectional view of one end of the fluid transport apparatus of FIG. 1.

A first embodiment of the water hammer pressure eliminator system 26 of the present invention is shown in FIG. 2. It is seen there that at both ends of the vessel 22 a compartment 30 is formed using the head 32 and a portion of the length of the wall 34 of the vessel as part of the compartment surface. The interior wall of the compartment is formed by an internal partition 36 extending across the diameter of the interior of the vessel 22 and secured thereto. This internal partition 36 is preferably elliptically or hemispherically configured and disposed towards the center of the vessel. It is constructed such that its strength before failure on application of pressure from the interior of the vessel 22, as during a water hammer pressure event, is approximately one-half that of the walls of the vessel 22 itself. The elliptical internal partition 36 has a thickness of approximately one-half of the thickness of the shell of the vessel 22. The compartment 30 thereby formed is filled with a compressible gas 38 which is selected to be above its critical temperature at all normal ambient temperatures.

This internal partition or wall 36 can be provided with one or more orifices 40 sized to allow the volume of the compartment 30 thereby formed to fill with vessel fluid 24 in about one to two seconds, if the fluid is passing through these orifices at approximately the speed of sound under operating conditions. These orifices 40 are equipped with frangible or rupture discs 42 rated to break at a pressure differential somewhat below the collapsing strength of the internal partition 36.

The compartment 30 is preferably pressurized with an inert gas 38, such as nitrogen, selected to be above its critical temperature during normal operation, and pressurized to a pressure up to one-half the working pressure of the vessel 22. For example, if the working pressure of the vessel fluid 24 is four hundred psig, then the compartment 30 can be preloaded with nitrogen at two hundred psig, and the rupture discs 42 set at eight hundred psig. The compartment 30 can further be outlined with a membrane bladder 44. The rupture discs 42 disposed in the orifices 40 can then form a surface of this bladder 44, or they can be attached and supported directly by the internal partition 36.

Figure 3:
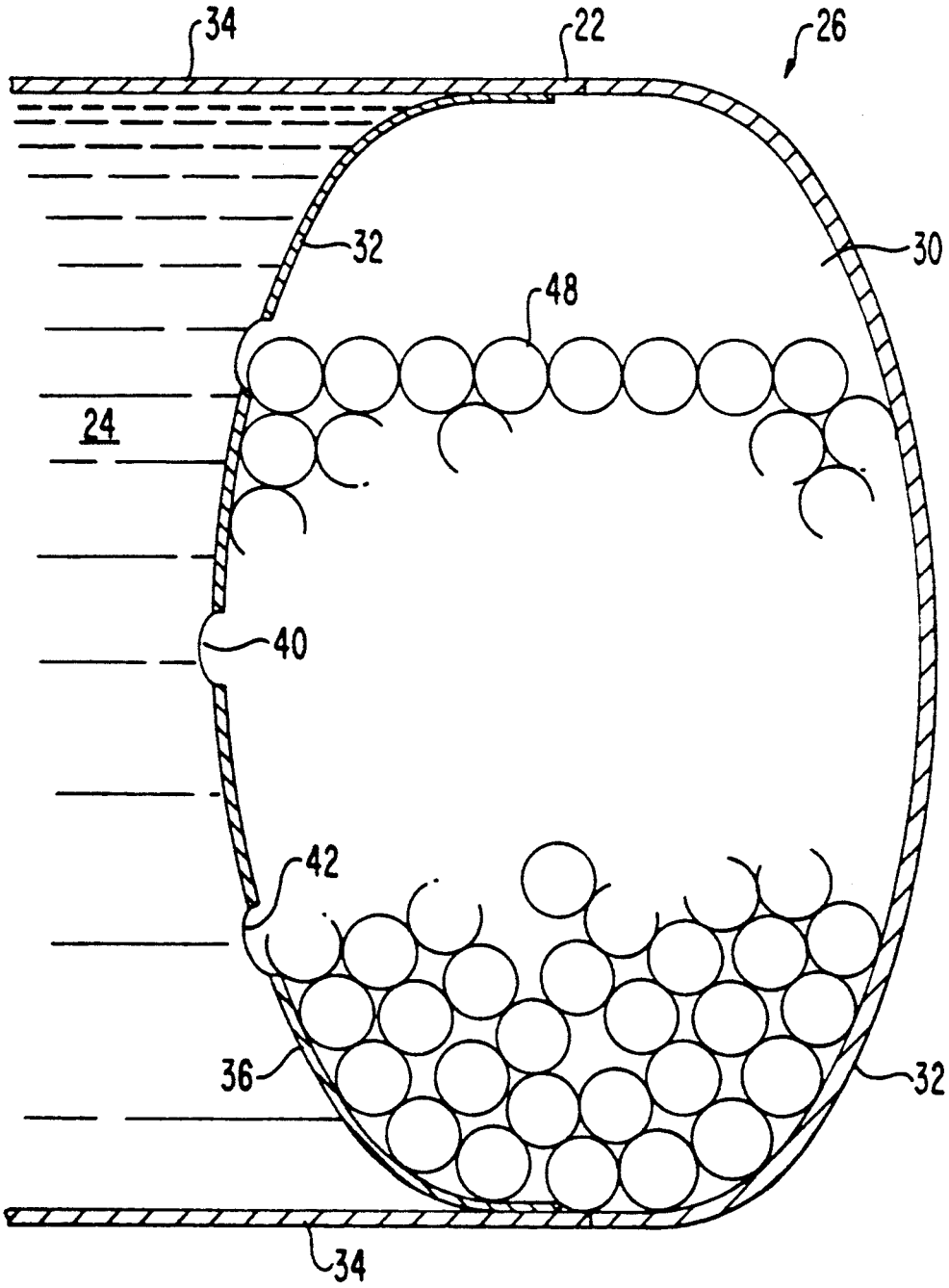
FIG. 3 is a view similar to that of FIG. 2 illustrating an alternative embodiment thereof.

An alternative to the system of FIG. 2 is shown in FIG. 3 wherein a plurality of collapsible containers 48 are disposed in the end compartment 30. These containers 48 can be shaped as spheres, ellipsoids or cylinders and are preloaded or pressurized with an inert gas above its critical temperature. An example of suitable collapsible containers 48 is common pressurized rubber balls, such as tennis balls. In lieu of these containers 48 the compartment 30 can be filled or substantially filled with crushable or collapsible media such as low density foamed urethane, styrene or rubber.

Figure 4:
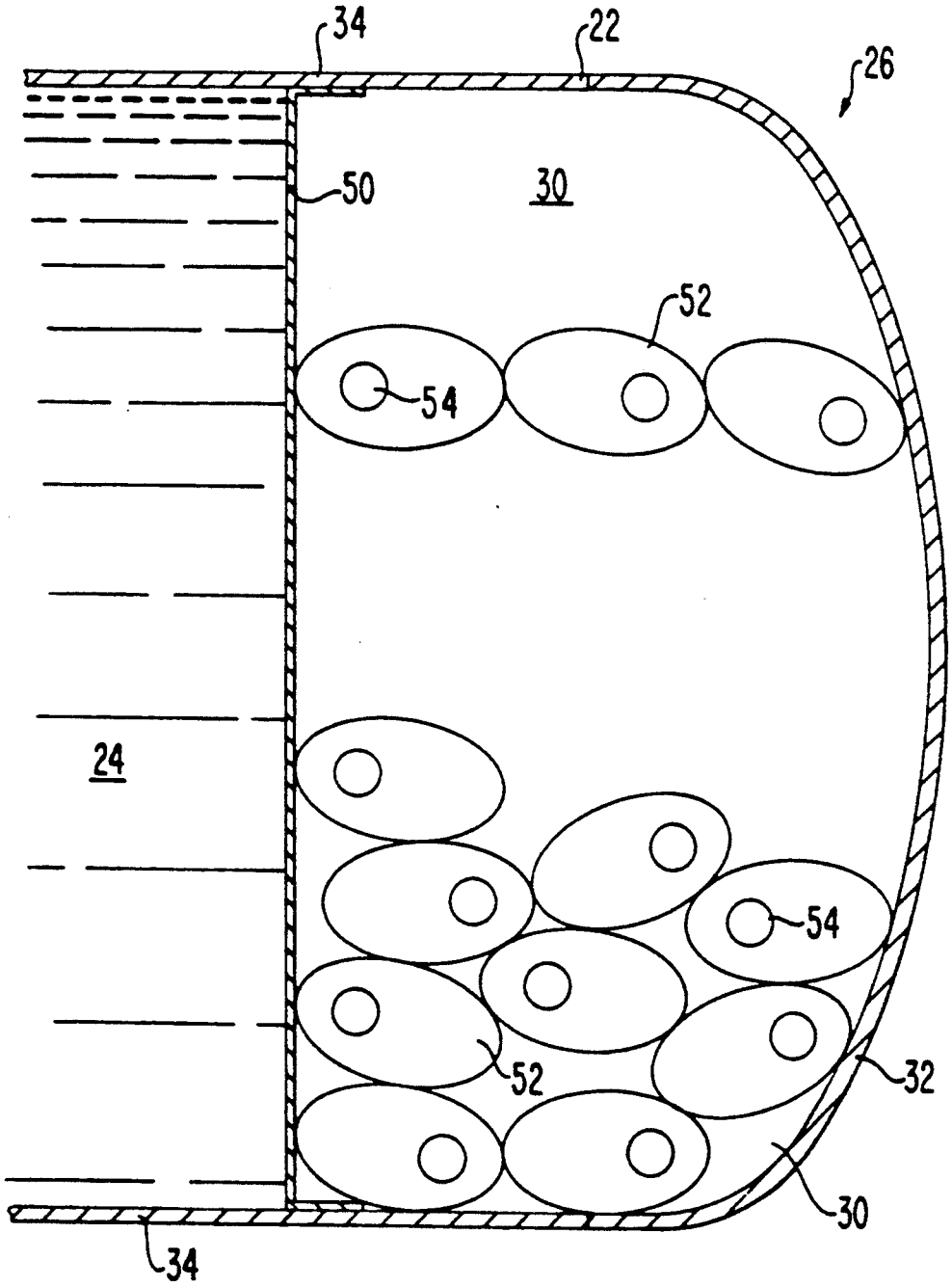
FIG. 4 is a view similar to that of FIGS. 2 and 3 illustrating a further embodiment.

A further variation of this system is illustrated in FIG. 4. In this variant, the internal partition 50 is formed merely by a restraining mesh or a lightweight, non-pressure bearing membrane to maintain the contents of the compartment 30 in position at the ends of the vessel 22. The volume of the end compartment 30 thereby formed is then filled or substantially filled with leak-tight spherical or ellipsoidal containers 52. These containers 52 are preferably of a compatible metal such as stainless steel and contain a compressible gas above its critical temperature. Containers 52 are pressurized to at least one-half the working pressure of the vessel 22 itself with this gas, and they are designed to maintain their shape and integrity throughout the working pressure range of the vessel. However, by design, they will fail once a set pressure is exceeded as during a water hammer event. This failure can be due to a careful selection of the thickness of the walls of the containers 52 so that they thereby crush. Alternatively, they can fail by rapidly admitting fluid therein, as by providing rupture discs 54 thereon.

The behavior of the water hammer eliminator system(s) 26 as illustrated in FIGS. 1–4 and described herein will now be described. In normal operation, the system 26 occupies dead space inside of the vessel 22, preferably equal to about twenty percent of the volume of the liquid 24 in the vessel 22, that is ten percent at each end thereof. At the time of impact, the liquid 24 in the vessel 22 forms a column moving towards the impacted end at no more than the speed of the vessel just prior to impact. As the liquid 24 meets the area of the compartment 30 crushing forces rapidly develop, breaking the rupture discs 42, if any, and spilling the liquid 24 into the volume of the compartment 30. If no discs are present then the crushing force pushes the entire partition 36 (or 50) back into the compartment 30, thereby sacrificing the weaker internal partition wall. The gas trapped in the compartment 30 and/or in the smaller containers 48 or 52 therein, such as the tennis balls and so forth, is then compressed rapidly absorbing the energy of the column of liquid in compressive work. The filling of the compartment 30 and/or of the individual containers 48, 52 therein with the liquid or the crushing of the compartment 30 and/or the media (balls 48, foam and so forth) therein by the oncoming liquid consumes a finite amount of time which is at least as long as the time required for the initial pressure wave of the impacting liquid to travel the length of the vessel 22 and reflect back to the point of origin where it can begin to cancel the pressure rise resulting from the impact.

Figure 5:
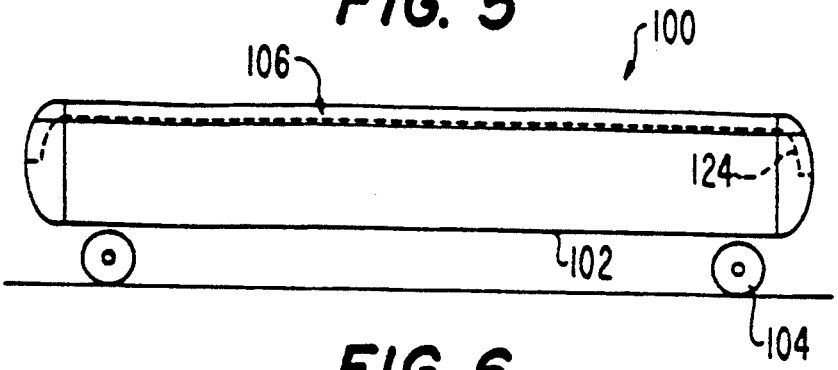
FIG. 5 is a schematic side elevational view of a second fluid transport apparatus of the present invention.
Figure 6:
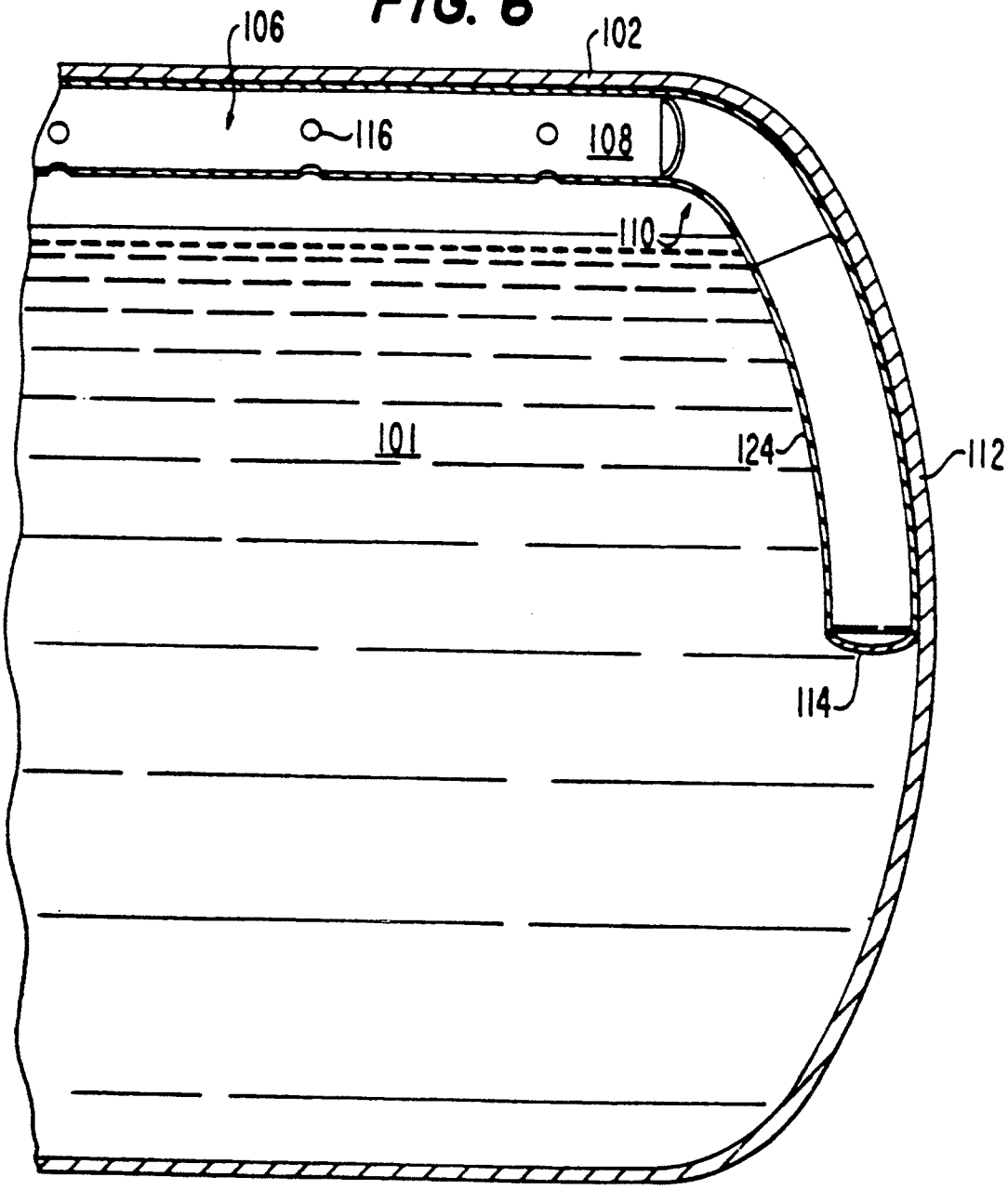
FIG. 6 is an enlarged longitudinal cross-sectional view of one end of the fluid transport apparatus of FIG. 5.
Figure 7:
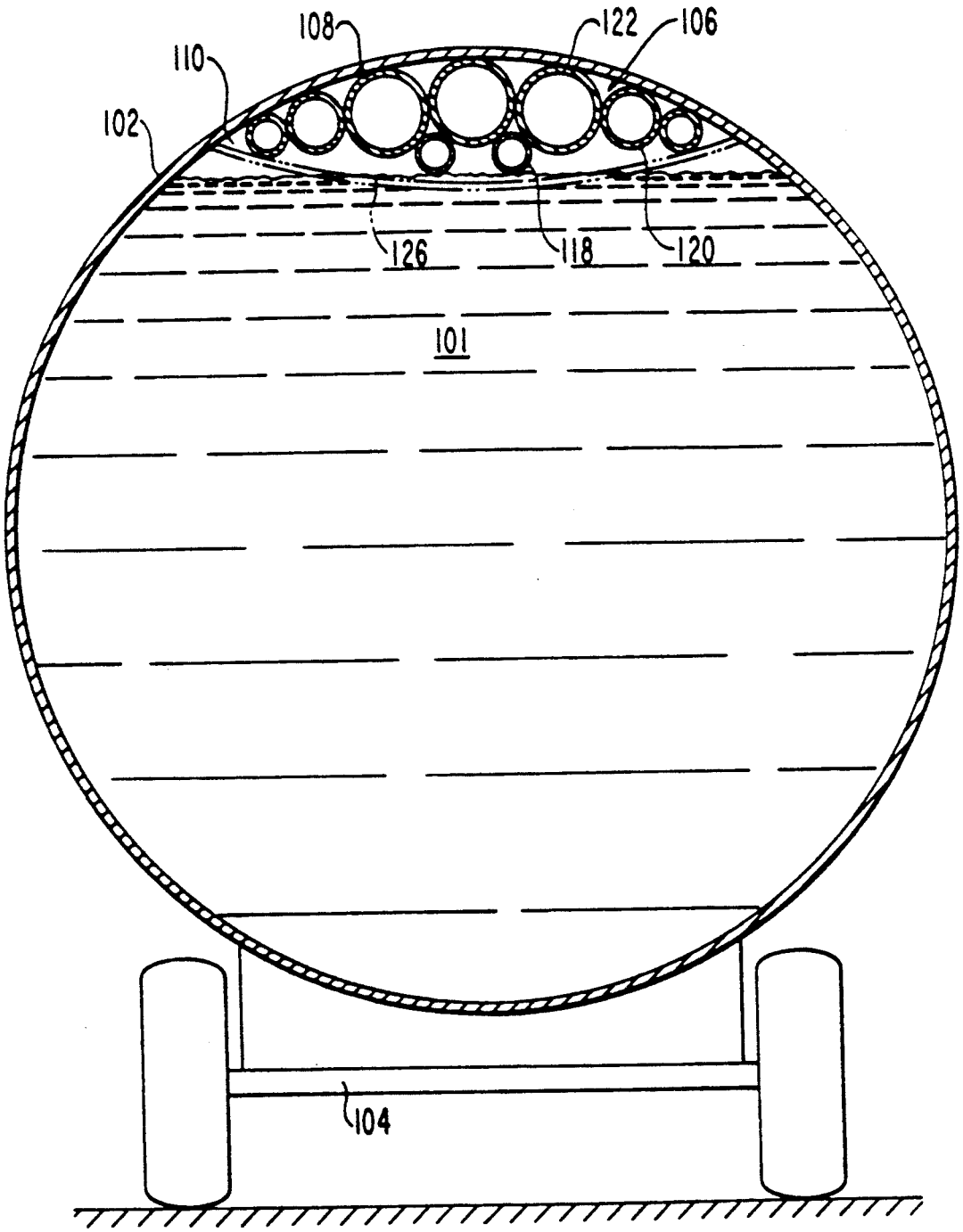
FIG. 7 is an enlarged lateral cross-sectional view of the fluid transport apparatus of FIG. 5 illustrating an alternative embodiment thereof.

An alternative fluid transport apparatus of the present invention is shown in FIGS. 5–7. FIG. 5 in particular shows in schematic form generally at 100 a fluid transport apparatus for transporting liquified pressurized gas 101, for example. The fluid transport apparatus 100 is shown to include a fluid transport vessel 102 mounted for transport on wheel assemblies 104. The water hammer pressure eliminator system of this system is shown generally at 106 within the fluid transport vessel 102, and is shown in greater detail in FIGS. 6 and 7. This system consists of one or more pipes or passages 108 running longitudinally the full length of the vessel 102 to be protected, preferably, along its entire upper surface and occupying the volume normally allotted to the "vapor space" 110 in a typical vessel carrying a liquified compressed gas such as propane, ammonia, chlorine or hydrogen sulfide. Each passage 108 preferably terminates at the end of the vessel 102 approximately in the center of the head 112 of the vessel 102. Ends of the passages 108 are closed with rupture discs 114 designed to fail open should the pressure outside of the passage 108 exceed the pressure inside of the passage by a modest level, such as fifty pounds per square inch.

The pipe 108 can be judiciously perforated with a small number of small apertures 116 along the top and bottom surfaces thereof. The bottom drain holes or apertures 116 each have approximately two inch diameters and are positioned at approximately every two feet along the pipe 108. These apertures 116 are provided so that, under normal operating conditions, the pipe 108 can continue to serve as a "vapor space" 110 in the vessel, and so that no differential pressure normally exists between the interior of the pipe 108 and the interior of the vessel therebeneath. Any liquid 101 from the vessel splashed into or condensing in the pipe 108 easily drains out of the bottom apertures 116. These apertures 116, however, are sized small enough such that a period of time, preferably more than ten seconds, is required for the pipe 108 to fill with liquid 101 should the vessel 102 be suddenly turned upside down. The normal contents of the pipe 108 are therefore always substantially all vapor. The pipe 108 is attached firmly to the walls of the vessel 102 such that it cannot loosen in the event of a collision impact and thereby act as a battering ram against the vessel head 112.

The passages 108 typically comprise one or more straight longitudinal pipes 118, 120, 122 ending preferably with a rupture disc 114 and an elbow extension 124 extending therefrom downwardly along the contour of the head 112 to approximately the center line of the vessel as best shown in FIG. 6. These adjacent pipes 118, 120, 122, such as are shown in FIG. 7, can, for example, include four inch pipes, six inch pipes and eight inch pipes.

A longitudinal plate baffle 126 can also be welded at either end to the shell of the vessel 102 to define an additional flow channel area. The baffle 126 can be used with or without the pipes 118, 120, 122. While the baffle 126 itself forms a conduit, it, if of sufficient strength, can act as a vapor space water hammer eliminator. Since the pipes 118, 120, 122 are more rigid and less likely to fail during the initial pressure rise of the collision, their use is preferred over that of the baffle 126 alone.

When the vessel 102 does not have sufficient vapor space 110 to allow for about ten percent internal volume for the passages 108, then some of the passages are not perforated. Rather, they are closed and equipped only with the rupture discs at each end thereof to assure that they are filled with gas at all times. These discs must be of sufficient bursting pressure to accommodate the normal working pressure of the vessel.

The behavior of the water hammer eliminator system 106 will now be described. When the fluid transport apparatus 100 derails or collides, the fluid vessel 102 moves or tumbles briefly out of control. During this brief period, liquid 101 may or may not tend to flow into the passages 108 depending on the orientation and spin of the vessel. The rate of flow, however, is limited by the small size and number of the apertures 116. Therefore, the passage 108 remains substantially liquid free during this brief tumble period. Upon a head-on impact followed by sudden deceleration the liquid 101 in the vessel (and the lesser amount of liquid, if any, in the passage 108) rapidly forms a liquid column with momentum initially in the same direction as that of the vessel 102 prior to impact. The liquid 101 in the vessel quickly fills the entire space available at the impacted head end, and the wave of water hammer pressure begins to rise. As this pressure rises and travels it meets with resistance from the liquid in the vessel and the compartment walls begin to deform. It also meets the insubstantial resistance posed by the rupture discs 114 (if any) and the column of vapor or gas in the compartment. The disc 114 is thereby torn away, and the liquid finds a low resistance passage into which it can travel with relatively low pressure drop until the velocity in the passage 108 approximately equals the speed of sound.

Since the speed of sound is at least ten times the highest probable velocity change to be encountered by fluid in a suddenly stopped highway or rail vessel traveling at sixty miles per hour or less, it is appropriate to size the cross-sectional area of the passage 108 to be about ten percent of the cross-sectional area of the vessel 102 itself. The liquid pressure developing at the impact head end is therefore translated into a very high velocity flow of liquid in the reverse direction through the now opened passage 108, thereby effectively limiting the developing pressure wave crest during the initial milliseconds after collision. The pressure wave travels considerably faster in the liquid (main body of the vessel 102) than it will in the passage 108, which contains some vapor, due to the different speed of sound in liquid and vapor. In a typical length car, the liquid column returning up the passage 108, takes about one hundred to one thousand milliseconds to reach the exit end of the passage 108. At the exit end the liquid easily breaks the low pressure disc 114 and jets into the lower pressure area at the far end of the vessel. By this time, however, the pressure wave in the main body of liquid will have already reached the far end of the liquid column and reflected back (probably several times). These reflected waves, traveling about four thousand feet per second, reach the impacted head of a typical length tank car about twenty-five milliseconds after the initial impact, and immediately begin to limit and then cancel out the pressure rise from the initial impact. At this early point in time, and during the critical "rise" period, the liquid is still freely "escaping" up the passage 108 effectively limiting the highest pressure reached during the episode to a relatively low value.

A principal advantage of this system 106 is that it does not consume a significant amount of dead space inside the vessel 102 itself, since its occupied volume also serves as the normal, accessible vapor space 110 of the vessel 102.

Thus, the present invention is a system involving one or more simple devices added to a transportation pressure vessel to increase the compressibility of the system and/or to increase the length of time for fluid deceleration in the vessel stopped by sudden impact as during a collision or derailment. This system reduces the magnitude of the pressure waves developed during the sudden deceleration of a liquid, commonly known as "water hammer" pressure, thereby decreasing the probability of vessel failure during or following a collision.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A liquid transport apparatus comprising:

a liquid transport vessel having a vessel interior, a vessel top wall, a vessel first end wall, a vessel second end wall, and a vapor space in said vessel interior and along said vessel top wall; and water hammer pressure dissipating tubular piping positioned in said vapor space and extending longitudinally between said vessel first and second end walls, said tubular piping being filled with a compressible fluid, said tubular piping being constructed, configured and positioned so that when said liquid transport vessel is impacted with such severity as to produce water hammer pressure, liquid in said vessel interior enters said tubular piping and compresses said compressible fluid thereby at least substantially dissipating the water hammer pressure in said vessel interior;

wherein said tubular piping has a plurality of small apertures such that said tubular piping serves as part of the vapor space in said liquid transport vessel and so that no differential pressure normally exists between the interior of said tubular piping and said vessel interior beneath said tubular piping with said vessel at rest;

wherein said tubular piping includes at least one rupture member, said rupture member, when said liquid transport vessel is impacted, being caused to rupture by the resulting surge of liquid in said vessel interior, thereby compressing said compressible fluid and dissipating the water hammer pressure in said vessel interior; and wherein said tubular piping has a piping end generally adjacent said first vessel end wall, and said rupture member is positioned and extends across said piping end.

2. The liquid transport apparatus of claim 1 further comprising a second rupture member at the other end of said tubular piping.

3. A liquid transport apparatus comprising:

a liquid transport vessel having a vessel interior, a vessel top wall, a vessel first end wall, a vessel second end wall, and a vapor space in said vessel interior and along said vessel top wall; and water hammer pressure dissipating tubular piping positioned in said vapor space and extending longitudinally between said vessel first and second end walls, said tubular piping being filled with a compressible fluid, said tubular piping being constructed, configured and positioned so that when said liquid transport vessel is impacted with such severity as to produce water hammer pressure, liquid in said vessel interior enters said tubular piping and compresses said compressible fluid thereby at least substantially dissipating the water hammer pressure in said vessel interior;

wherein said tubular piping has a plurality of small apertures such that said tubular piping serves as part of the vapor space in said liquid transport vessel and so that no differential pressure normally exists between the interior of said tubular piping and said vessel interior beneath said tubular piping with said vessel at rest; and wherein said tubular piping includes at least one rupture member, said rupture member, when said liquid transport vessel is impacted, being caused to rupture by the resulting surge of liquid in said vessel interior, thereby compressing said compressible fluid and dissipating the water hammer pressure in said vessel interior; and wherein said rupture member is at an end of said tubular piping.

4. The liquid transport apparatus of claim 3 wherein said rupture member has a rupture strength of at least fifty pounds per square inch.

5. A liquid transport apparatus comprising:

a liquid transport vessel having a vessel interior, a vessel top wall, a vessel first end wall and a vessel second end wall; and water hammer pressure dissipating piping in said vessel interior extending generally longitudinally between generally said vessel first and second end walls, said piping being filled with a compressible fluid, said piping being configured and positioned so that, when said liquid transport vessel is impacted, the liquid enters said piping and compresses said compressible fluid thereby dissipating the water hammer pressure in said vessel interior;

wherein said piping includes at least one rupture member, said rupture member, when said liquid transport vessel is impacted, being caused to rupture by the resulting surge of liquid in said vessel interior, thereby compressing said compressible fluid and dissipating the water hammer pressure in said vessel interior; and wherein said piping has a piping end generally adjacent said first vessel end wall, and said rupture member is positioned and extends across said piping end.

6. The liquid transport apparatus of claim 5, further comprising a second rupture member at the other end of said piping.

7. A liquid transport apparatus comprising:

a liquid transport vessel having a vessel interior, a vessel top wall, a vessel first end wall and a vessel second end wall; and water hammer pressure dissipating piping in said vessel interior extending generally longitudinally between generally said vessel first and second end walls, said piping being filled with a compressible fluid, said piping being configured and positioned so that, when said liquid transport vessel is impacted, the liquid enters said piping and compresses said compressible fluid thereby dissipating the water hammer pressure in said vessel interior;

wherein said piping includes at least one rupture member, said rupture member, when said liquid transport vessel is impacted, being caused to rupture by the resulting surge of liquid in said vessel interior, thereby compressing said compressible fluid and dissipating the water hammer pressure in said vessel interior; and wherein said rupture member is at an end of said piping.

8. The liquid transport apparatus of claim 7, wherein said rupture member is set at least fifty pounds per square inch rupture strength.

9. A liquid transport apparatus comprising:

a liquid transport vessel having a vessel interior, a vessel top wall, a vessel first end wall, a vessel second end wall, and a vapor space in said vessel interior and generally along said vessel top wall; and water hammer pressure dissipating conduit positioned in said vapor space, and extending longitudinally between said vessel first and second end walls;

wherein said conduit has a first end generally at said first end wall, a second end generally at said second end wall, and conduit interior between said first and second ends;

wherein said conduit has a plurality of small apertures such that said conduit serves as at least part of said vapor space in said vessel and so that no substantial differential pressure normally exists between said conduit interior and said vessel interior immediately beneath said conduit with said vessel at rest; and wherein said conduit is constructed, configured and positioned and secured to said vessel so that when said vessel is impacted with such severity as to produce water hammer pressure, liquid in said vessel interior enters said conduit through said first end, passes through said conduit interior and exits out said second end, thereby substantially dissipating water hammer pressure in said vessel interior.

10. The liquid transport apparatus of claim 9 wherein said conduit has a lower conduit surface, and at least some of said apertures are on said lower conduit surface such that they can serve a conduit drainage function.

11. The liquid transport apparatus of claim 9 further comprising a longitudinal baffle extending longitudinally beneath said conduit and in said vessel interior.

12. The liquid transport apparatus of claim 9 wherein said conduit includes at least one rupture member, said rupture member, when said vessel is impacted, rupturing by the resulting surge of liquid in said vessel interior, thereby dissipating water hammer pressure in said vessel interior.

13. The liquid transport apparatus of claim 12 wherein said rupture member is positioned and extends across said conduit first end.

14. The liquid transport apparatus of claim 13 further comprising a second rupture member across said conduit second end.

15. The liquid transport apparatus of claim 12 wherein said rupture member has a rupture strength of at least fifty pounds per square inch.

16. The liquid transport apparatus of claim 9 wherein said apertures are sized small enough such that a period of time is required for said conduit to fill with the liquid in said liquid transport vessel when said liquid transport vessel is suddenly turned upside down.

17. The liquid transport apparatus of claim 16 wherein the period of time is more than ten seconds.

18. The liquid transport apparatus of claim 16 wherein said small apertures are along the top and bottom surfaces of said conduit.

19. The liquid transport apparatus of claim 9 wherein said conduit is securely attached to said vessel so as to not become separated therefrom in the event of a collision impact and thereby act as a battering ram.

20. The liquid transport apparatus of claim 9 wherein said conduit comprises pipe which is at least four inches in diameter.

21. The liquid transport apparatus of claim 9 wherein said conduit comprises a plurality of longitudinal pipes generally parallel and adjacent to one another.

22. The liquid transport apparatus of claim 21 wherein said plurality of pipes comprise pipes having different diameters.

23. The liquid transport apparatus of claim 22 wherein the different diameters are four inches, six inches and eight inches.

24. The liquid transport apparatus of claim 9 wherein said conduit includes a longitudinal pipe and an elbow member extending from said longitudinal pipe along said first end wall and down to generally a center line of said vessel.

25. The liquid transport apparatus of claim 9 wherein said vessel top wall defines the upper portion of a vessel cylindrical shell extending between said vessel first end wall and said vessel second end wall.

26. The liquid transport apparatus of claim 9 wherein said conduit has its uppermost surface spaced below said vessel top wall.

27. The liquid transport apparatus of claim 9 wherein said conduit has a curved pipe surface shape.

28. The liquid transport apparatus of claim 9 wherein said conduit comprises at least one pipe having a generally cylindrical cross-section.

29. The liquid transport apparatus of claim 9 wherein said apertures are each approximately two inches in diameter and spaced approximately every two feet along said conduit.

30. The liquid transport apparatus of claim 9 further comprising wheel assemblies attached to and on which said vessel rides.

31. The liquid transport apparatus of claim 9 wherein the liquid in said vessel interior comprises liquified pressurized gas, and said conduit interior, with said liquid transport vessel at rest, is filled with the saturated vapor of that liquified pressurized gas.

32. A liquid transport apparatus comprising:

a liquid transport vessel having a vessel interior, a vessel top wall, a vessel first end wall and a vessel second end wall; and water hammer pressure dissipating tubular piping positioned in said vessel interior, and extending longitudinally between said vessel first and second end walls;

wherein said conduit has a first end generally at said first end wall, a second end generally at said second end wall, and conduit interior between said first and second ends;

wherein said conduit includes a first rupture member across said first end and a second rupture member across said second end; and wherein said conduit is constructed, configured and positioned so that when said vessel is impacted with such severity as to produce water hammer pressure, liquid in said vessel interior ruptures said first rupture member, enters said conduit through said first end, passes through said conduit interior, ruptures said second rupture member and exits out said second end, thereby at least substantially dissipating water hammer pressure in said vessel interior.

33. The liquid transport apparatus of claim 32 wherein said vessel includes a vapor space in said vessel interior and generally along said vessel top wall, and said piping is positioned in said vapor space.

34. The liquid transport apparatus of claim 33 wherein said conduit has a plurality of small apertures such that said conduit serves as part of said vapor space in said vessel and so that no substantial differential pressure normally exists between said conduit interior and said vessel interior immediately beneath said conduit with said vessel at rest.

35. The liquid transport apparatus of claim 33 wherein said vapor space is less than ten percent of said volume interior.

36. The liquid transport apparatus of claim 33 wherein said conduit interior, with said vessel at rest, is filled with vapor of the liquid in said vessel interior.

* * * * *